US007610966B1

(12) United States Patent
Weintraub et al.

(10) Patent No.: US 7,610,966 B1
(45) Date of Patent: Nov. 3, 2009

(54) STOVETOP FIRE EXTINGUISHER

(75) Inventors: Preston N. Weintraub, Keller, TX (US); Don Murray, Arlington, TX (US); Michael R. Stevens, Midlothian, TX (US)

(73) Assignee: Williams-Pyro, Inc., Fort Worth, TX (US)

( * ) Notice: Subject to any disclaimer, the term of this patent is extended or adjusted under 35 U.S.C. 154(b) by 318 days.

(21) Appl. No.: 11/654,838

(22) Filed: Jan. 18, 2007

(51) Int. Cl.

| | |
|---|---|
| ***A62C 3/00*** | (2006.01) |
| *A62C 35/02* | (2006.01) |
| *A62C 25/00* | (2006.01) |
| *A62C 37/12* | (2006.01) |

(52) U.S. Cl. ..... 169/65; 169/26; 169/52; 169/57; 169/59; 169/28

(58) Field of Classification Search ..... 169/65, 169/26, 52, 57, 59, 28, 36
See application file for complete search history.

(56) References Cited

U.S. PATENT DOCUMENTS

| | | | | | |
|---|---|---|---|---|---|
| 3,040,815 | A | * | 6/1962 | Pambello | 169/57 |
| 3,209,837 | A | * | 10/1965 | Freedman | 169/42 |
| 3,773,111 | A | * | 11/1973 | Dunn | 169/26 |
| 3,833,063 | A | | 9/1974 | Williams | |
| 3,874,458 | A | | 4/1975 | Williams | |
| 3,884,306 | A | * | 5/1975 | Williams | 169/59 |
| 3,884,307 | A | * | 5/1975 | Williams | 169/59 |
| 3,897,828 | A | | 8/1975 | Glover | |
| 3,918,526 | A | * | 11/1975 | Hattori et al. | 169/51 |
| 4,113,020 | A | * | 9/1978 | Panetta | 169/26 |
| 4,964,469 | A | | 10/1990 | Smith | |
| 5,351,760 | A | * | 10/1994 | Tabor, Jr. | 169/65 |
| 5,518,075 | A | | 5/1996 | Williams | |
| 5,868,205 | A | * | 2/1999 | Cunningham et al. | 169/65 |
| 5,871,057 | A | | 2/1999 | Stehling et al. | |
| 5,881,819 | A | | 3/1999 | Walters et al. | |
| 6,105,677 | A | | 8/2000 | Stager | |
| 6,244,353 | B1 | | 6/2001 | Greer | |
| 6,276,461 | B1 | * | 8/2001 | Stager | 169/65 |
| 6,796,382 | B2 | | 9/2004 | Kaimart | |

* cited by examiner

*Primary Examiner*—Len Tran
*Assistant Examiner*—Steven Cernoch
(74) *Attorney, Agent, or Firm*—Morani Patent Law, P.C.

(57) ABSTRACT

A fire extinguisher includes a bracket, a housing, extinguisher containers and a directing member such as a ramp. The fire extinguisher is designed to be located above a stove and beneath structure, such as microwave oven and vent. Such structure typically has low clearance relative to the stovetop and the burners thereon. The housing and containers are suspended from the bracket. Each container has a fire extinguishing powder and an initiator for breaching a container wall. One of the containers is directly positioned over a burner on the stovetop. The other container is offset laterally from another burner on the stovetop. The ramp is used to direct the fire extinguishing powder of this container onto the burner. The ramp is maintained in a stowed position by a fusible link, which gives way when a fire is present on the second burner causing the ramp to fall to a deployed position before the respective container discharges its powder.

14 Claims, 11 Drawing Sheets

STOVETOP FIRE EXTINGUISHER

FIELD OF THE INVENTION

The present invention relates to apparatuses and methods for automatically initiating in the presence of a fire and disbursing an extinguishing agent and in particular to stovetop fires.

BACKGROUND OF THE INVENTION

In a kitchen, grease fires and other types of fires are a concern. For example, a pan of grease on a stove burner can become so hot that it ignites. A grease fire left unextinguished can burn the walls around and above the stove. If unattended, the fire can spread and cause considerable damage and risk of injury.

U.S. Pat. No. 5,518,075 discloses a fire extinguisher that is particularly well suited to a stovetop environment. The '075 patent provides a container of an extinguishing agent. The container is located above the stovetop, such as with a magnet secured to a hood over the stove. The bottom of the container contains a fuse. A fire on the stovetop ignites the fuse, which in turn detonates an igniter. The igniter opens the bottom of the container, thereby allowing the disbursement of the extinguishing agent onto the fire and the stovetop.

The extinguisher of the '075 patent is commonly found on stovetops having a hood over the stove. However, a number of kitchens utilize microhoods over stovetops. A microhood has a microwave oven and a hood fan. The microhood is located closer to the top of the stop than the prior hood. In addition, the microhood is mounted more rearwardly over the stovetop than is the hood. The front burners of the stovetop are typically left uncovered by the microhood.

These changes, namely the closer spacing and rearward location, means that an extinguisher like the '075 patent might not be able to adequately extinguish a fire on the front burners.

SUMMARY OF THE INVENTION

It is an object of the present invention to provide a fire extinguisher that can be located under a microhood of a stovetop.

The present invention provides a fire extinguisher that comprises a container and a directing member. The container forms a closed cavity and has a wall. A fire extinguisher powder is located in the cavity. An initiator breaches the container wall and allows the fire extinguishing powder to egress the container. The directing member is separate from and located adjacent to the container wall. The directing member is movable between a stowed position and a deployed position. The directing member in the deployed position is oriented so as to disperse the fire extinguishing powder egressing the container to a predetermined location. A fusible link retains the directing member in the stowed position.

In accordance with one aspect of the present invention the directing member comprises a ramp.

In accordance with still another aspect of the present invention there is at least one hinge for allowing the ramp to move between the stowed and deployed positions. The hinge has a stop for limiting the movement of the ramp beyond the deployed position.

In accordance with another aspect of the present invention a fuse extends from the fusible link to the igniter.

In accordance with still another aspect of the present invention when the fuse ignites, the fuse heats the fusible link before heating the initiator so as to allow the directing member to move to the deployed position before the initiator ignites.

In accordance with another aspect of the present invention the container wall has reinforcing ribs and weakened portions. The weakened portion is breached to allow the fire extinguisher powder to egress the container.

In accordance with still another aspect of the present invention the container wall has reinforcing ribs and weakened portions. The weakened portions breach to allow the fire extinguishing powder to egress the container. The directing member comprises a ramp. There is at least one hinge for allowing the ramp to move between the stowed and deployed positions. The hinge has a stop for limiting the movement of the ramp beyond the deployed position. A fuse extends from the fusible length to the igniter. When the fuse ignites, the fuse heats the fusible link before heating the igniter so as to allow the directing member to move to the deployed position before the initiator ignites.

In accordance with another aspect of the present invention the housing has a receptacle for the container. The directing member is coupled to the housing by at least one hinge.

In accordance with still another aspect of the present invention the container is a first container. There is a second container forming a second cavity and having a second container wall. A fire extinguishing powder is located in the second cavity. A second initiator breaches the second container wall. The second container is spaced from the first container and oriented so that the second container wall is directed down. The housing has a second receptacle for the second container.

The present invention also provides a fire extinguisher that comprises a mounting member, a housing, first and second containers and a wall. The housing is suspended from the mounting member. The housing comprises two cavities. The first and second containers each comprise a closed cavity and a fire extinguishing powder located in the cavity, as well as an igniter for breaching the container. The first container is located in one of the cavities and has a fuse that extends from the first container igniter downwardly. The second container is located in the other of the cavities. The second container has a second fuse that extends from the second container initiator laterally. The wall is located adjacent to the second container. The wall is oriented so as to disperse the powder in the second container laterally when the second container initiator ignites.

In accordance with one aspect of the present invention the wall moves from a stowed position to a deployed position. The wall is maintained in the stowed position by a fusible link.

In accordance with another aspect of the present invention the second fuse has a first portion adjacent to the fusible link and second portion leading to the second container igniter. The second fuse being configured so that the first portion burns before the second portion.

The fire extinguisher of claim 11 wherein the first and second containers are substantially similar to each other.

In accordance with still another aspect of the present invention the first and second containers are coupled to the mounting member.

In accordance with still another aspect of the present invention the mounting member is slidingly received by the housing. Each of the first and second containers is coupled to the mounting member by a slide-lock.

The present invention also provides a method of assembling a fire extinguisher. A housing with at least two receptacles is provided. The receptacles have bottoms that are open. A mounting member is inserted into the housing to a first position. The fire extinguisher containers are installed into each receptacle, with each container having a coupling member that intersects the mounting member. The mounting member is moved to a second position in the housing so that the mounting member couples to each of the coupling members.

In accordance with another aspect of the present invention a directing member is coupled to the housing beneath one of the containers. The directing member is movable between a stowed position and a deployed position. The directing member is secured in the stowed position by a fusible link.

In accordance with still another aspect of the present invention the step of inserting the mounting member into the housing to a first position further comprises the step of moving the mounting member until the mounting member engages a first stop. The step of moving the mounting member to a second position further comprises the step of moving the mounting member until the mounting member engages a second stop.

In accordance with still another aspect of the present invention the mounting member is mounted to a support by a stove so as to position the containers over a top of the stove.

In accordance with still another aspect of the present invention the mounting member is moved from the second position to the first position. At least one container in the housing receptacle is replaced. The mounting member is moved to the second position.

DESCRIPTION OF THE PREFERRED EMBODIMENT

The present invention provides a fire extinguisher 11 (see FIG. 1) that can be mounted over a stovetop 13, which stovetop has a relatively low cooking space, due to the presence of a structure 15 above the stovetop. The structure 15 is, in the preferred embodiment, a microhood, which is a combination microwave oven and vent. The fire extinguisher 11 can operate on other types of structure 15. The fire extinguisher 11 can be used on stovetops having structures 15 to 22 inches above the stovetop 13. This is a much lower clearance than on traditional stovetops, which have a clearance of between 26-34 inches.

Figure 1:
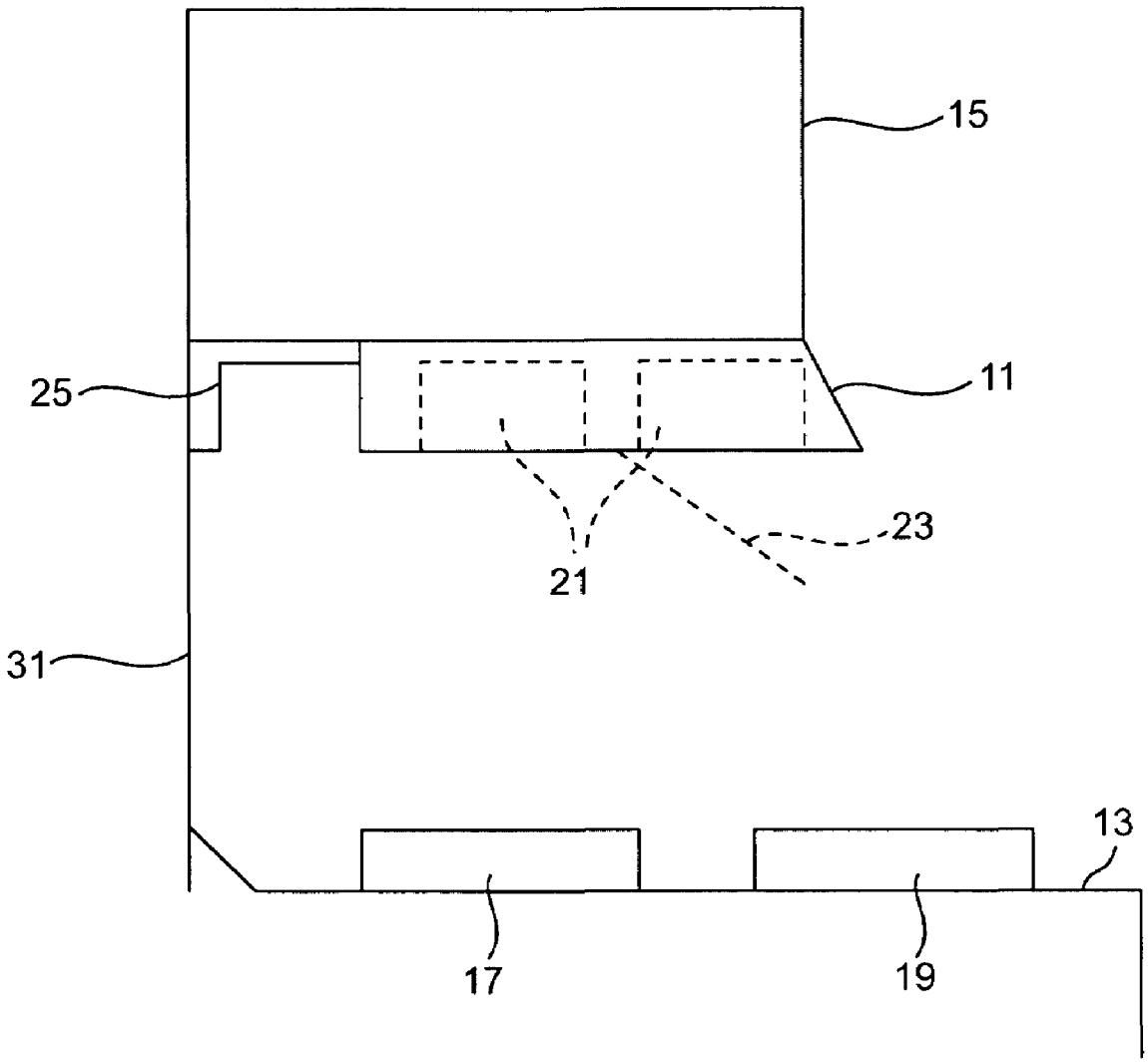
FIG. 1 is a schematic view of a stovetop, showing the fire extinguisher of the present invention, in accordance with a preferred embodiment.

The stovetop 13 has rear and front burners 17, 19. The fire extinguisher 11 can be used on stovetops where the structures 15 do not fully extend over the front burners 19. Thus, the front burners 19 are uncovered by the structure 15. As illustrated in FIG. 1, the structure 15 completely covers the rear burner 17 and covers only a small portion of the front burner 19. The fire extinguisher 11 is positioned beneath the structure 15 and extends out from the structure in a non-obtrusive manner. The fire extinguisher 11 is thus directly over the rear burner 17 and is only over a small portion, if any, of the front burner 19.

The fire extinguisher utilizes containers 21 of fire extinguishing substance, such as fire extinguisher powder. The containers 21 (shown by dashed lines in FIG. 1) have bottom walls that are breached by igniters. An igniter is ignited by a fuse, which fuse is located directly above a particular burner. The use is ignited by a fire on the stovetop 13. When the bottom wall of a container breaches or opens, the fire extinguisher powder is released in a generally downward direction, due to gravity. Due to the lateral offset of the fire extinguisher 11 from the front burner 19, a directing mechanism is deployed to direct the fire extinguisher powder to the front burner 19. In the preferred embodiment, this directing mechanism is a ramp 23 (shown in dashed lines in FIG. 1). The ramp 23 deploys from a stowed position to a deployed, or inclined, position before the container bottom wall opens.

The fire extinguisher 11 mounts easily to the underside of the structure 15. Once mounted, the fire extinguisher 11 is unobtrusive in that it does not interfere with the operations stove 13 or the structure 15. The ramp 23 is normally stowed beneath the extinguisher, out of the way. Yet, the fire extinguisher 11 is capable of extinguishing fires on both the rear and front burners 17, 19. Once installed, the fire extinguisher 11 operates automatically to extinguish stovetop fires. The fire extinguisher is inexpensive.

The stove 13 can be electric, gas, electromagnetic, induction, etc. The stove has heating elements or burners on top. The stove has rear and front burners 17, 19. A typical stove has four burners, with two rear burners and two front burners.

Figure 2:
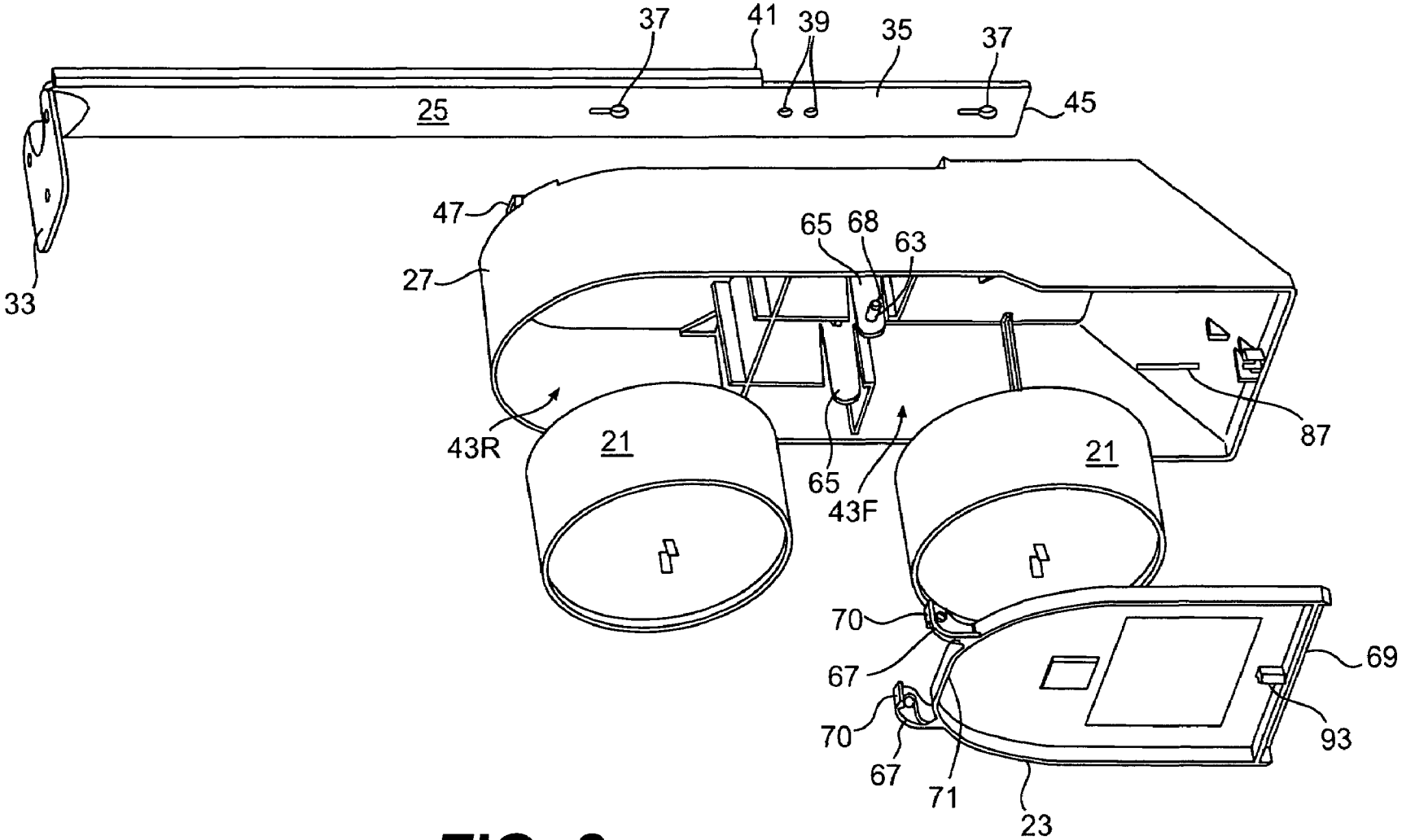
FIG. 2 is an exploded isometric view of the fire extinguisher, as shown from the bottom.

Referring to FIG. 2, the fire extinguisher 11 includes a bracket 25, a housing 27, plural extinguisher containers 21 and a ramp 23. In the description that follows, terms such as "front", "rear", "top" and "bottom" are used. These terms refer to the use of the extinguisher in its normal orientation, which is above the stove.

The bracket 25 is shown in FIG. 2. The bracket mounts to the rear wall 31 (see FIG. 1) behind the stovetop 13 and extends beneath the structure 15. The bracket suspends the housing 27, containers 21 and ramp 23 above the stovetop 13. The bracket 25 is an angle bracket, having a mounting portion 33 and an extension portion 35. The mounting portion 33 has holes for receiving fasteners, such as screws. The extension portion 35 has keyhole shaped openings 37, one for each container 21, as will be described below. In addition, the bracket has two openings 39 for receiving a retainer, to retain the bracket within the housing. The bracket also has raised lips 41 extending along the sides of the extension portion from the mounting portion to a location adjacent to the retainer openings 39.

The housing 27 is suspended from the bracket 25. The housing receives the extinguisher containers 21 and assists in coupling the containers to the bracket. In addition, the housing 27 and ramp 23 are coupled together.

Figure 3:
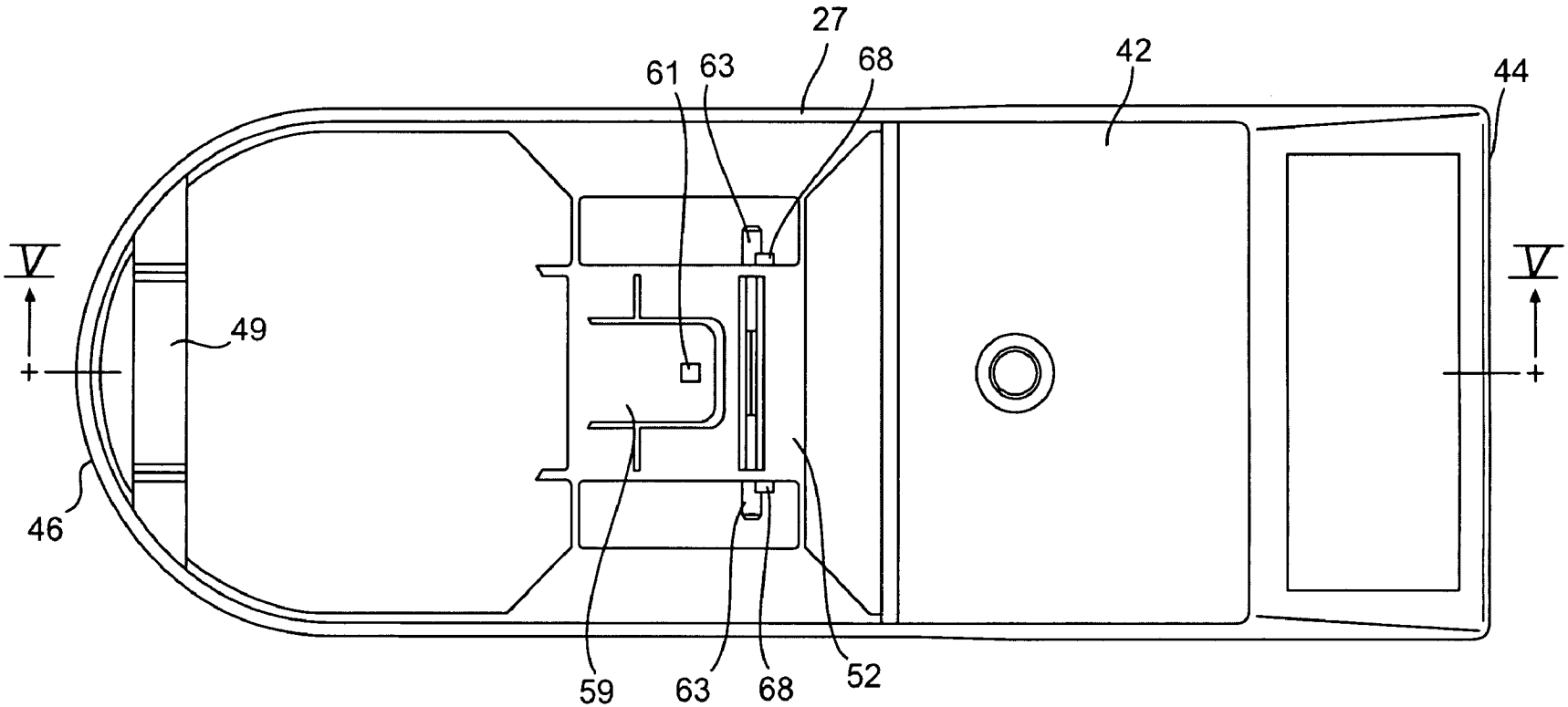
FIG. 3 is a top plan view of the housing.
Figure 4:
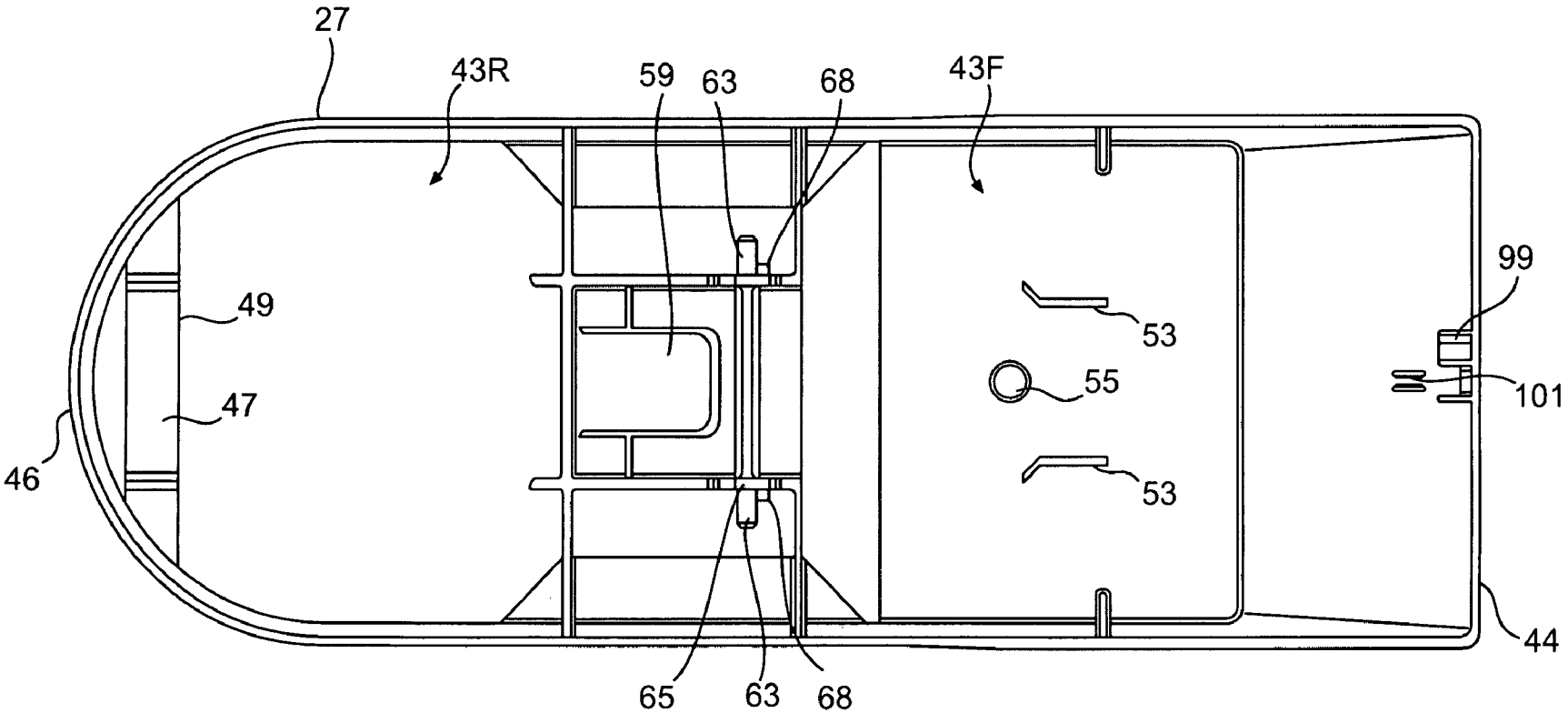
FIG. 4 is a bottom plan view of the housing.
Figure 5:
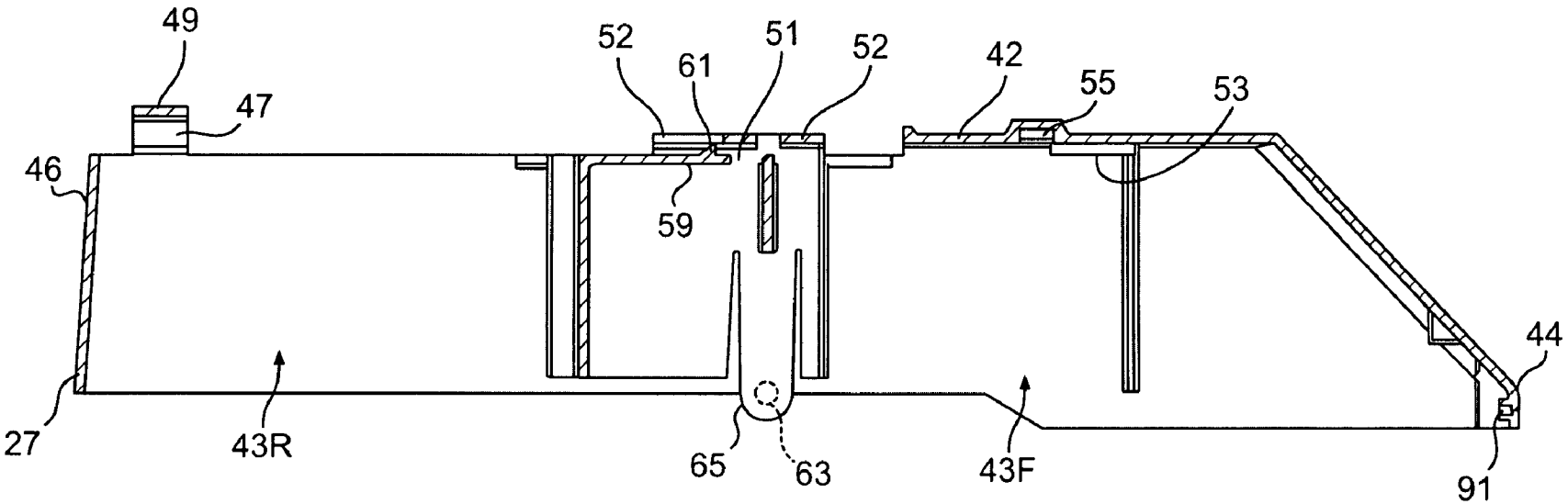
FIG. 5 is a cross-sectional view of the housing, taken through lines V-V of FIG. 3.

Referring to FIGS. 3-5, the housing has a front end 44, viewable by the stove operator, and a back end 46, that is close to the rear wall 31. The housing 27 has a top side (see FIG. 3) and a bottom side (see FIG. 4). The bottom side is generally open to receive the extinguisher containers. The top side has a top wall 42 near the front end 44 to prevent spilled liquids from the structure 15 from entering the housing. The remainder of the housing top can be open as it is located beneath the structure 15. The housing has cavities 43R, 43F for receiving the extinguisher containers (see FIG. 5). The cavities 43R, 43F limit side-to-side movement of the extinguisher containers 21.

Figure 6:
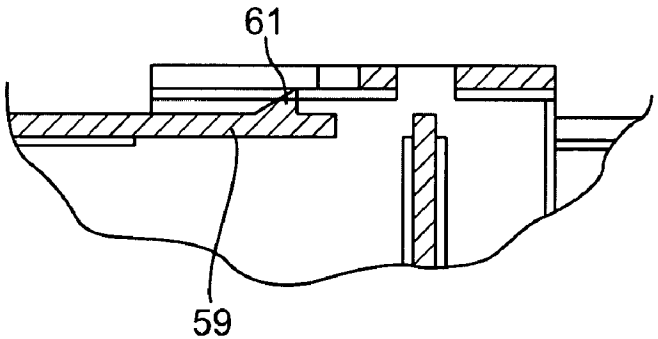
FIG. 6 is a detailed view of the bracket retainer.
Figure 14:
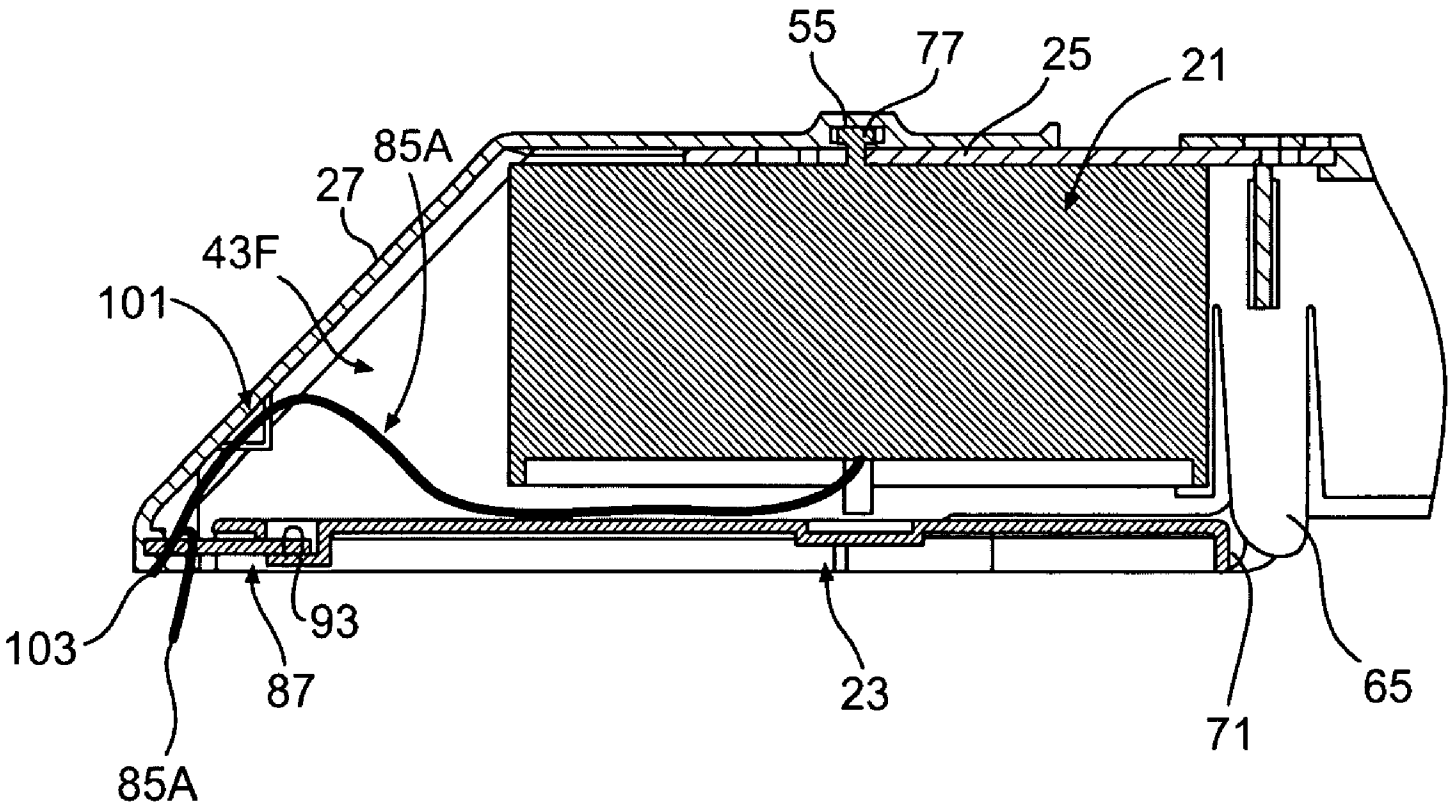
FIG. 14 is a cross-sectional view of the front portion of the extinguisher, taken through lines XIV-XIV of FIG. 13.

The top of the housing receives the bracket. The free end 45 of the extension portion of the bracket 25 is inserted through an opening 47 formed by a rear mounting wall 49, across the top of the rear cavity 43R, through an opening 51 formed by a front mounting wall 52, into the top of the front cavity 43F. Inside of the front cavity top wall 42 are guides 53 to center and position the free end 45 of the bracket 25. The guides 53 depend from the top wall 42. The top wall 42 has a small cavity 55 therein for receiving a clevis pin 57 of the front extinguisher container (see FIGS. 4 and 14). A retainer tab 59 is located beneath the bracket; the retainer tab 59 has a projection 61 that is received by the retainer openings 39 in the bracket. The projection 61 is sloped so as to allow the bracket to be inserted into the housing, but resists the bracket being withdrawn from the housing (see FIGS. 5 and 6). The retainer tab 59 can bend down to disengage the projection from the bracket.

The housing 27 has hinge pins 63 to couple the ramp 23 to the housing. Each hinge pin 63 is located on a tab 65; the tabs can bend toward each other to assemble the ramp to the housing. The hinge pins extend opposite of each other.

The ramp 23 has a front end 69 and a rear end 71. The ramp is a wall with a smooth top surface. Reinforcing ribs can be provided along the edges, on the bottom side, so as not to interfere with the extinguishing powder sliding along the top surface of the ramp. The ramp 23 is mounted to the housing by way of two hinge projections 67 at the rear end 71 (see FIG. 2). Each projection 67 has an opening for receiving a hinge pin 63.

Figure 12:
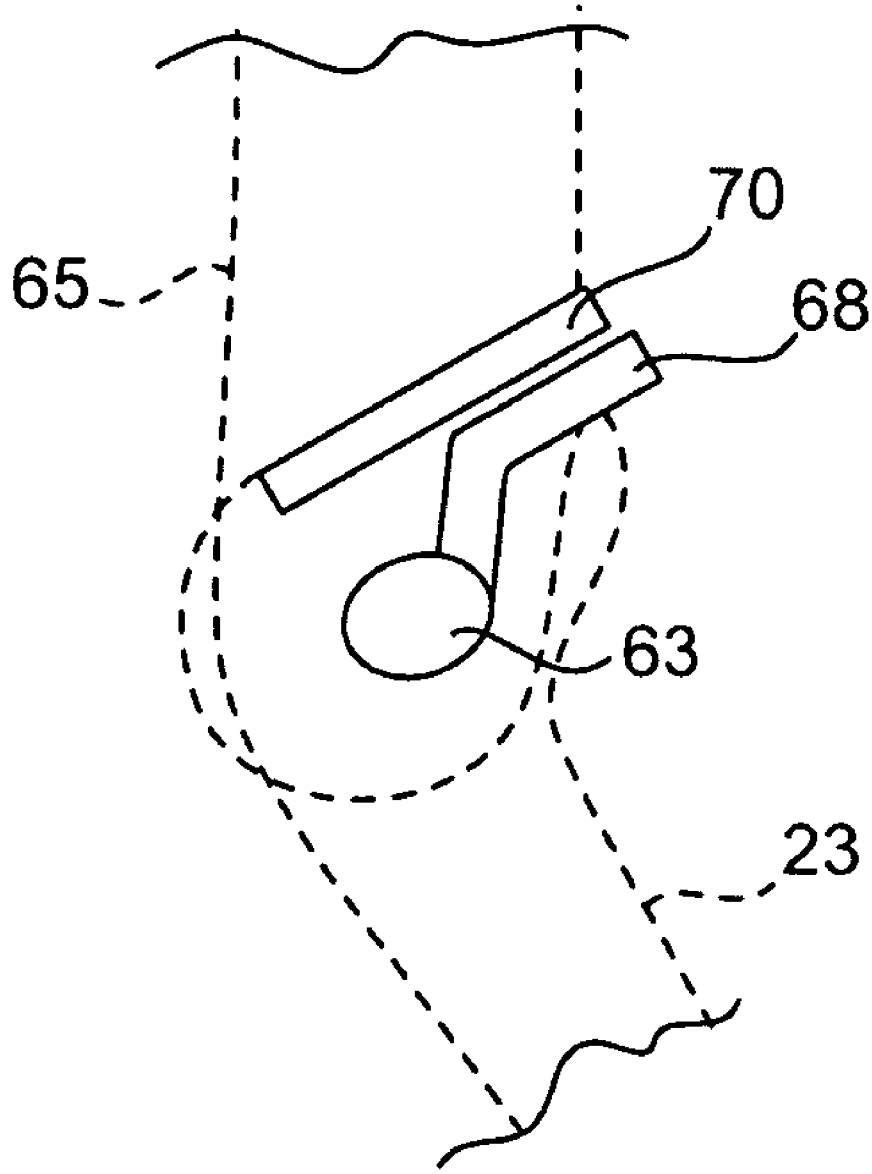
FIG. 12 is a detailed view of the ramp hinge stops.

The ramp 23 moves between a stowed position and a deployed position. In the stowed position, the ramp is horizontal and forms a bottom wall to the front cavity 43F (see FIG. 14). In the deployed position, the ramp is oriented so that the front edge 69 is down. The rear end 71 of the ramp remains up by virtue of the hinges 63, 67. In the preferred embodiment, the ramp when deployed is inclined at 50 degrees from the horizontal. The ramp is maintained at this angle by stops on the ramp projections 67 and the tabs 65. As can be seen in FIGS. 2-4, the housing tabs 65 have stops 68 adjacent to the hinge pins 63. The stops 68 extend only part of the length of the hinge pins. As can be seen in FIG. 2, the ramp projections 67 have stops 70 that extend from the projections 67. When the ramp is fully deployed (see FIG. 12), the stops 68, 70 engage each other, thereby preventing further rotation of the ramp.

The extinguisher containers 21 are conventional and are substantially similar to each other. The extinguisher containers 21 are of the type described in U.S. Pat. Nos. 3,884,307 and 5,518,075. The complete disclosure of U.S. Pat. No. 3,884,307 is incorporated herein by reference. Each extinguisher container 21 has a metal cup-shaped member that receives a lower lid 73 (see FIGS. 10 and 11) or wall. Located inside of the container is a fire extinguisher substance 75, preferably a fire extinguisher powder, which may be of the ABC type or the BC type. As is well know, the ABC type is formed by about 90% monoammonium phosphate with about 10% silicones and other material (silica, ground mica) added to keep it free flowing and protect the powder from moisture. The BC type is about 90 to 94% bicarbonate. The balance of the material is stearates or silicones or other materials added to keep the powder free flowing and protect the bicarbonate from moisture.

The top wall of the container 21 has a clevis pin 77. The clevis pin is received by one of the keyhole shaped openings 37 in the bracket. The bottom wall 73 of the container 21 has score lines 79 that form weakened portions of a wall and reinforcing ribs 81. The container 21 has an igniter 83. When the igniter ignites, the weakened portions 79 of the bottom wall open and allow the powder to discharge.

Figure 10:
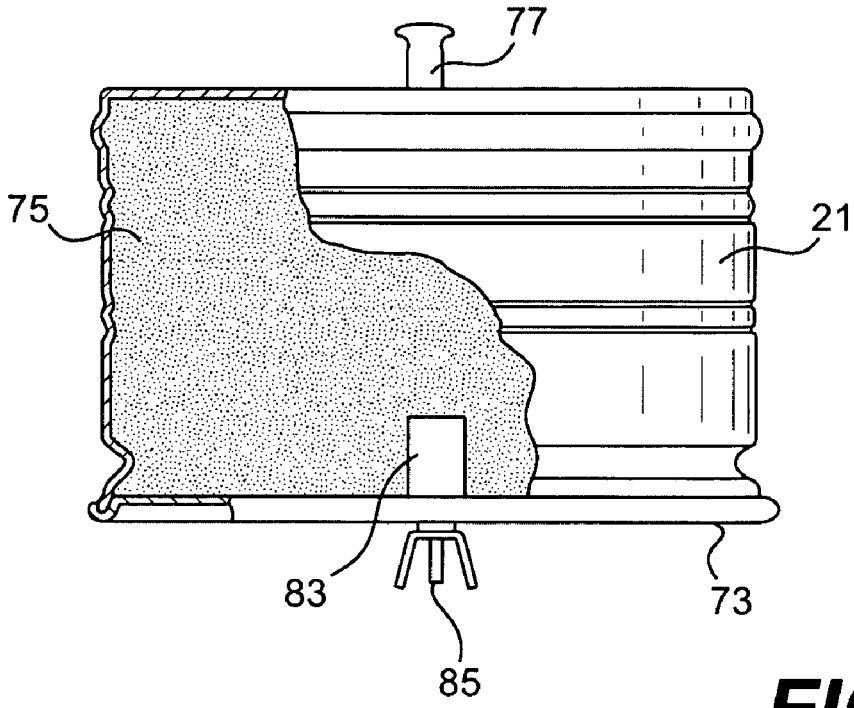
FIG. 10 is a side view of one of the extinguisher containers.
Figure 11:
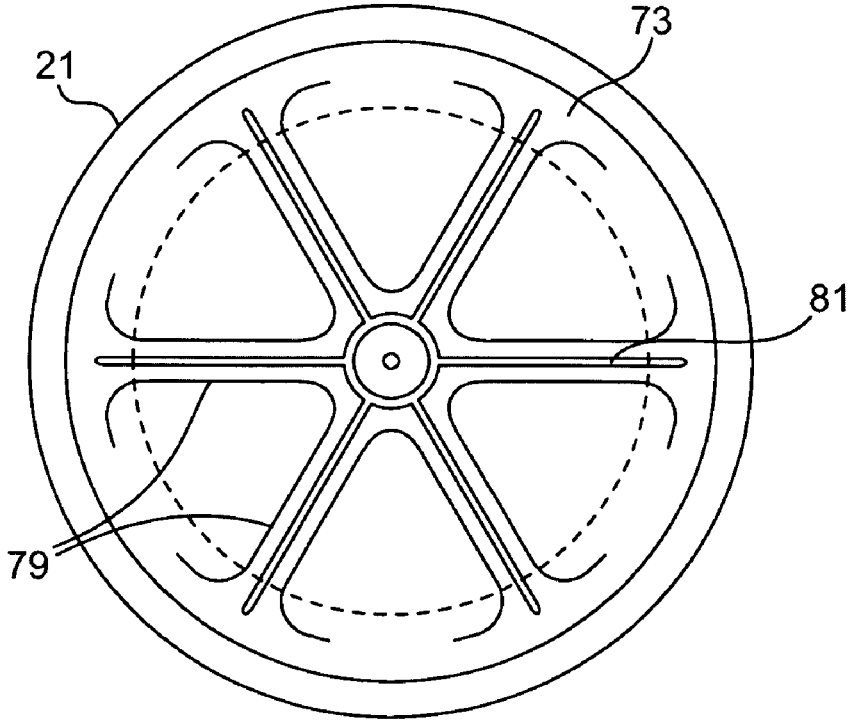
FIG. 11 is a bottom view of an extinguisher container.

The containers 21 have fuses 85 that become ignited when exposed to a sufficient amount of heat. FIG. 10 shows one such fuse 85, as configured for the rear container. The fuse on the front container is longer and involves the ramp, as will be explained below. The fuses on the bottom side of the containers are exposed to the stovetop.

Figure 9:
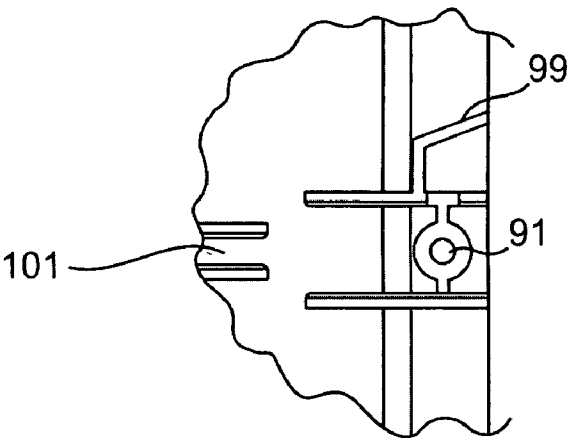
FIG. 9 is a detailed view of the fuse and solder holder taken along lines IX-IX of FIG. 8.
Figure 8:
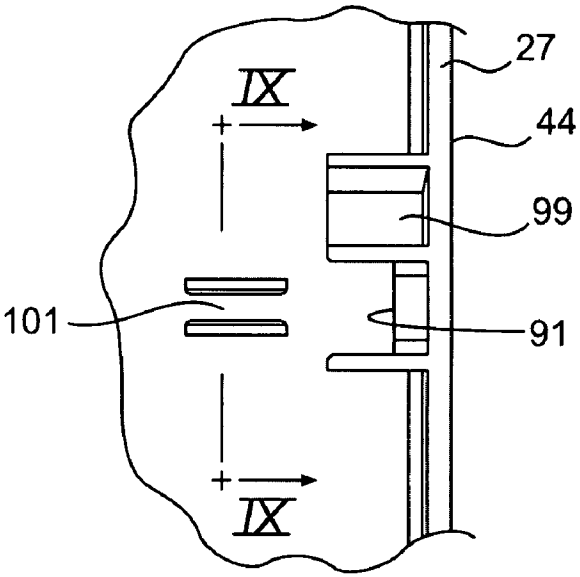
FIG. 8 is a detailed view of the fuse and solder holder of the housing.

The inside of the front end 44 of the housing 27 has structure for securing the ramp 23 and its fuse. This structure includes an opening 91 and a wall 99. There is also a slot 101 between two walls for receiving the fuse. The ramp is held in the stowed position by a fusible member or link. In the preferred embodiment, the fusible link is a length of solder wire 87 (see FIGS. 2 and 14). The wire 87 extends into an opening 91 in the housing (see FIGS. 8 and 9) and a corresponding opening 93 in the ramp, near the front edge 69. The fuse 85A from the front container extends from the igniter to the wire 87, and out of the housing. The fuse 85A is wrapped 103 around the wire 87. The remaining length of the fuse 85A extends down. The housing has the wall 99 to direct the fuse end down.

Figure 7:
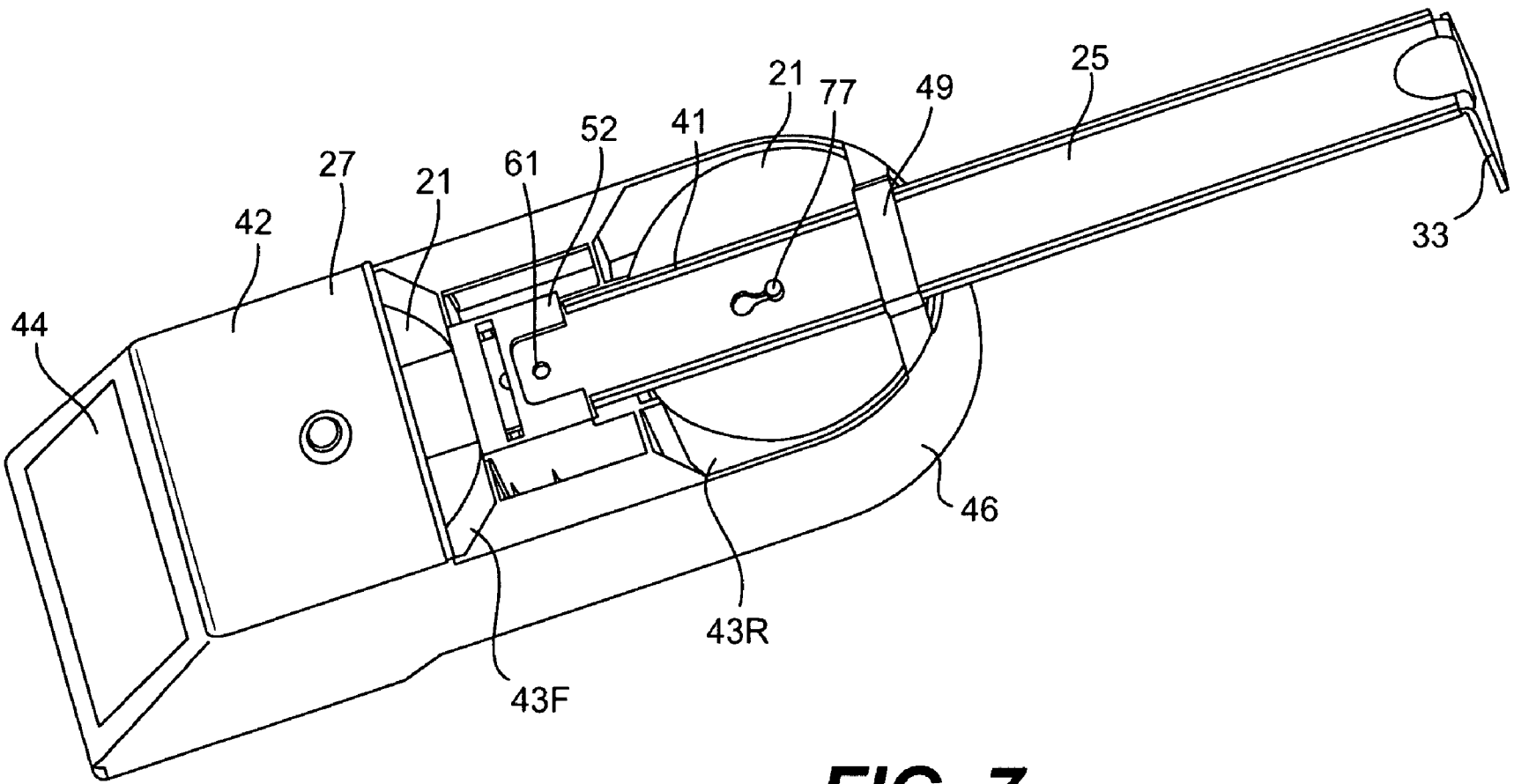
FIG. 7 is an isometric view of the top of the extinguisher.
Figure 13:
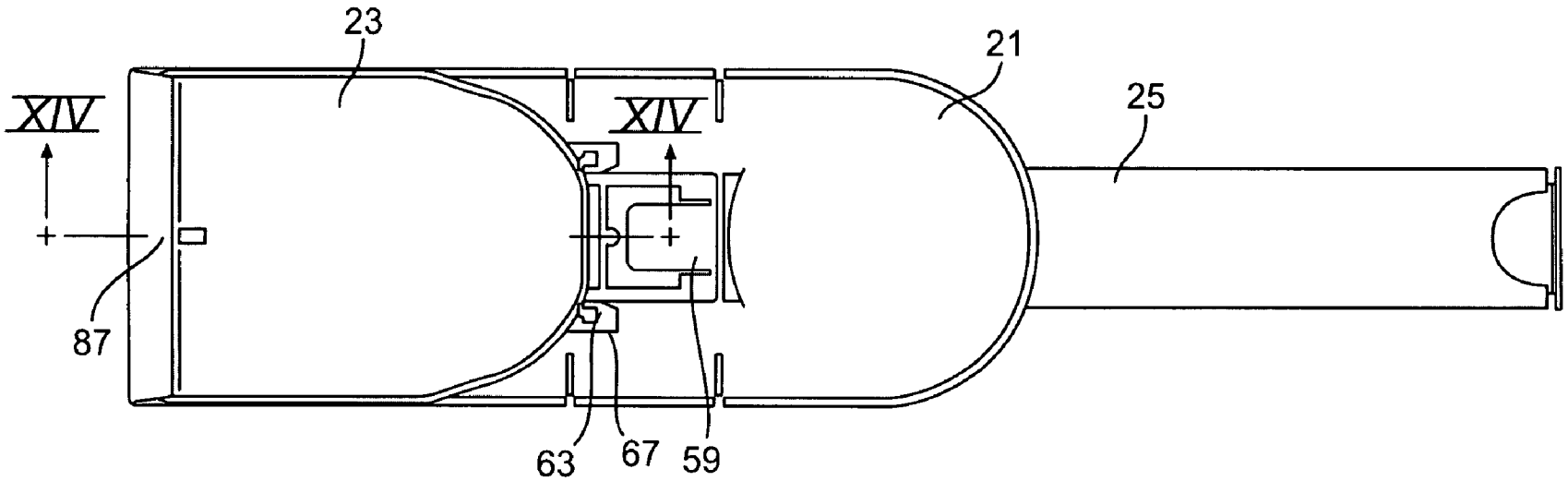
FIG. 13 is a bottom view of the extinguisher, shown with the ramp stowed.

To assemble the extinguisher 11, the bracket 25 is inserted into the top of the housing 27 until the forward retainer opening 39 nearest the free end 45 catches the retainer tab projection 61. The bracket 25 slides into the housing. In this first position, the bracket keyhole shaped openings 37 are positioned in the center of the respective cavities 43R, 43F, with the widest part of the openings centered. This allows the keyhole shaped openings to receive the clevis pins 77 of the containers 21. A container 21 is installed into each cavity 43R, 43F with the clevis pins intersecting the bracket by being received by the bracket openings 37. Once the containers are installed, the bracket is pushed further into the housing. The bracket 25 slides or moves to a second position. The lips 41 serve as stops against mounting wall 52. In this position of the bracket, the retainer tab projection 61 engages the other (rear most) retainer opening 39 in the bracket 25. The clevis pins 77 of the containers 21 are now locked into the narrow portion of the keyhole openings 37 of the bracket, thus securing the containers 21 to the bracket 25. Other slide-lock arrangements can be used to couple the containers 21 to the mounting member. The wire 87 is inserted into the housing opening 91. The wire 87 has the front end of the fuse 85A wrapped 103 around it. The free end of the fuse 85A is positioned so as to extend down and out of the housing. The wall 99 assists in directing the free end of the fuse 85A down. The ramp 23 is then located so as to receive the free end of the wire 87 in the ramp front end opening 93. The rear end 71 of the ramp is secured to the hinge pins 63 by pressing the hinge projections 65 toward each other. This reduces the spacing between the hinge pins 63 so that the ramp projections 67 can be inserted into the housing. When released, the hinge pins 63 are received by the hinge pin openings in the ramp projections 67. The extinguisher 11 is now assembled. FIG. 7 shows a top isometric view of the fully assembled extinguisher 11. FIG. 13 shows a bottom view of the fully assembled extinguisher 11.

The extinguisher 11 is mounted to the underside of a microhood 15 or other structure, as shown in FIG. 1, so as to be above the burners 17, 19. The mounting portion 33 of the bracket 25 is secured to the wall 31 by fasteners. The front end 44 of the extinguisher may extend slightly out from underneath the microhood 15.

The extinguisher described herein is suitable for two burners, rear and front. For a four burner stove, two extinguishers will be used, with one extinguisher for each pair of rear and front burners. Alternatively, an extinguisher can be mounted directly to the structure 15 or to a side wall, which side wall is located to one side of the stovetop 13.

The rear container of each extinguisher is located directly over the rear burner 17. The rear container is exposed directly to the rear burner 17. There is no wall between the rear container and the rear burner 17. Thus, a fire on the rear burner, such as in a pan, will ignite the igniter and the rear container will operate in the conventional manner, with the igniter detonating and the bottom wall 73 rupturing. Upon rupture, powder 75 falls by gravity downward onto the fire below. The fuses 85, 85A are ignited by heat and/or fire.

The front container is not located directly over the front burner and is offset vertically toward the rear. Locating the front container directly over the front burner would result in the extinguisher jutting out and interfering with access to the rear burner and possibly operation of the microhood 15. The end of the fuse 85A is located directly over the front burner 19. Thus, when a fire is on the front burner, the free end of the fuse 85A ignites. The burning fuse melts the wire 87 that holds the ramp 23 in the stowed position. The ramp falls 23 to the deployed position. As the ramp 23 deploys, the fuse 85A continues to burn. By the time the fuse 85A burns to the igniter 83 inside of the container 21, the ramp 23 is deployed. Upon ignition, the front container opens at the bottom wall 73 and the powder 75 falls down. The ramp 23 directs the powder to the front burner 19.

After the extinguisher has been activated, it can be removed from the wall, disassembled and new extinguisher containers 21 installed. Thus, the housing 27 and bracket 25 of the extinguisher can be reused. If only one container has been activated, then that container is replaced.

Although the present invention has been described as providing two containers 21, an extinguisher can be used that has only one container and a ramp, or other type of directing member. For example, a container can be vertically offset from a stovetop burner and that container uses a ramp to direct the extinguishing powder to the burner.

Although the present invention has described a particular mechanism for coupling the containers 21 to the bracket 25, the containers can be coupled by other mechanism besides a slide-lock arrangement (described herein as clevis pins 77 and slots 37). For example, the containers can be coupled by way of a cotter pin, or threaded into the bracket. Also, the containers can be coupled to the housing instead of to the bracket.

The fire extinguisher 11 is easy to assemble. Once assembled, the fire extinguisher can be mounted above a stove easily and quickly. The fire extinguisher uses conventional extinguisher containers 21. Consequently, the fire extinguisher is relatively inexpensive and easy to use. After activation, recharging the extinguisher is simple, it is disassembled and the open container is replaced.

The foregoing disclosure and showings made in the drawings are merely illustrative of the principles of this invention and are not to be interpreted in a limiting sense.

The invention claimed is:

1. An under a microwave automatic stovetop fire extinguisher assembly, the assembly comprising: a mounting member forming an L shape, which affixes to a back wall on one end and connects to a housing on an opposite end; the housing comprising:

a top side and a bottom side, wherein the top side connects to the opposite end of the mounting member; a front receptacle; a back receptacle; and a hinged trap door, that when deployed deflects the fire extinguishing material; a first and a second closed cavity container, housed in the front and back receptacle, respectively; wherein, the first and second closed cavity containers each contain fire extinguishing powder and each comprising an initiator and a fuse, respectively; wherein, the bottom side of the housing comprises openings in the front and back receptacles beneath the housed front and back containers, the openings configured to span the diameter of the first and second containers, respectively; and wherein, the hinged trap door is disposed beneath the front receptacle opening on the bottom side of the housing.

2. The fire extinguisher of claim 1 further comprising: a stop on the hinge which limits the movement of the hinged trap door beyond the deployed position.

3. The fire extinguisher of claim 1 wherein the first fuse extends from beneath the housing to the fusible link and onto the initiator of the front closed cavity container.

4. The fire extinguisher of claim 3 wherein when the fuse ignites, the fuse heats the fusible link before heating the initiator so as to allow the hinged trap door to move to the deployed position before the initiator ignites.

5. The fire extinguisher of claim 1 wherein the closed cavity container has reinforcing ribs and weakened portions, which weakened portions breach to allow the fire extinguisher powder to egress the container.

6. The fire extinguisher of claim 1 wherein the hinged trap door moves from a stowed position to a deployed position, the hinged trap door maintained in the stowed position by a fusible link.

7. The fire extinguisher of claim 6, wherein the second fuse has a first portion adjacent to the fusible link and a second portion leading to the back closed cavity container initiator, the second fuse being configured so that the first portion burns before the second portion.

8. The fire extinguisher of claim 1 wherein the front and back closed cavity containers are coupled to the mounting member.

9. The fire extinguisher of claim 8 wherein the mounting member is slidingly received by the housing, each of the front and back closed cavity containers being coupled to the mounting member by a slide-lock.

10. A method of assembling an under a microwave automatic stove top fire extinguisher, comprising the steps of: providing a housing with a front and a back receptacle, the receptacles having bottoms that are open; inserting a mounting member into the housing to a first position; installing a fire extinguisher container comprising a closed cavity into each front and back receptacle, each closed cavity container having a coupling member that intersects the mounting member; moving the mounting member to a second position in the housing so that the mounting member couples to each of the coupling members.

11. The method of claim 10, further comprising the steps of: coupling a hinged trap door to the housing beneath the front closed cavity container, the hinged trap door movable between a stowed position and a deployed position; securing the hinged trap door in the stowed position by a fusible link, wherein the fusible link is not integral to nor attached to the mounting member.

12. The method of claim 10 wherein: the step of inserting a mounting member into the housing to a first position further comprises the step of moving the mounting member until the mounting member engages a first stop of the housing; the step of moving the mounting member to a second position further comprising the step of moving the mounting member until the mounting member engages a second stop of the housing.

13. The method of claim 10 further comprising the step of mounting the mounting member to a support by a stove so as to position the containers over a top of the stove.

14. The method of claim 10 further comprising the steps of: moving the mounting member from the second position to the first position; replacing at least one closed cavity container in the housing front and back receptacles; and then moving the mounting member back to the second position.

* * * * *